US005406467A

United States Patent [19]

Hashemi

[11] Patent Number: 5,406,467

[45] Date of Patent: Apr. 11, 1995

[54] VENTILATION SYSTEM FOR MOTOR VEHICLE LIGHT FIXTURE

[75] Inventor: Masoud Hashemi, Dearborn, Mich.

[73] Assignee: Ford Motor Company, Dearborn, Mich.

[21] Appl. No.: 283,936

[22] Filed: Aug. 1, 1994

[51] Int. Cl.[6] ..... F21V 29/00

[52] U.S. Cl. ..... 362/294; 362/61; 362/373; 55/327

[58] Field of Search ..... 362/61, 80, 294, 345, 362/373; 55/327, 332

[56] References Cited

U.S. PATENT DOCUMENTS

| | | | |
|---|---|---|---|
| 4,405,974 | 9/1983 | Quiogue | 362/362 |
| 4,739,458 | 4/1988 | Yamayoshi et al. | 362/294 |
| 5,041,949 | 8/1991 | Hirota et al. | 362/294 X |
| 5,207,497 | 5/1993 | Kamishina et al. | 362/61 |

*Primary Examiner*—Stephen F. Husar

*Attorney, Agent, or Firm*—Charles H. Ellerbrock; Roger L. May

[57] ABSTRACT

A ventilation system (18) for a motor vehicle light fixture (10) comprises a rubber tube (20) adapted for connection to the light fixture (10), a filter (22) positioned within the rubber tube (20), and a hollow insert (24) having a plurality of baffles (30) positioned within the rubber tube (20) and adjacent the end of the tube exposed to the atmosphere.

17 Claims, 1 Drawing Sheet

FIG. 1.
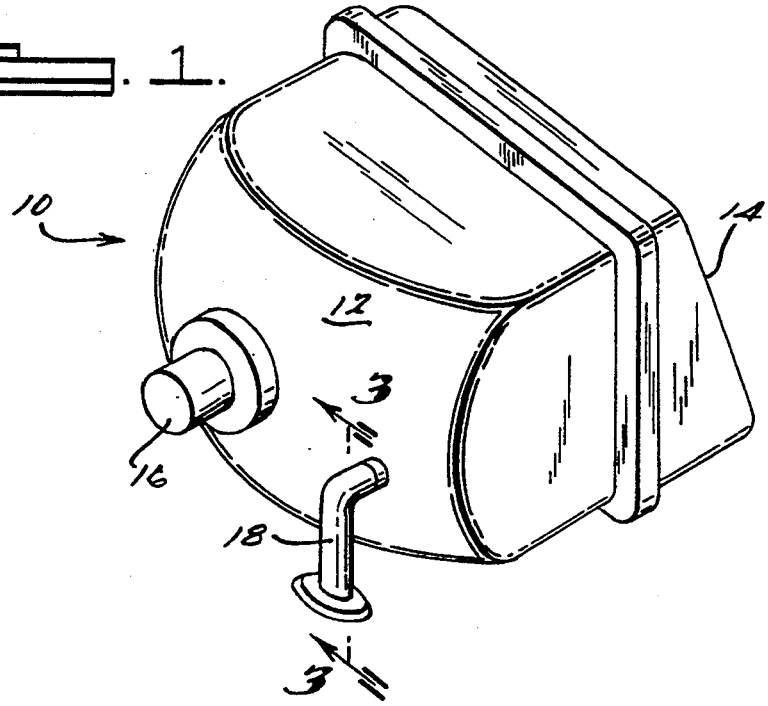
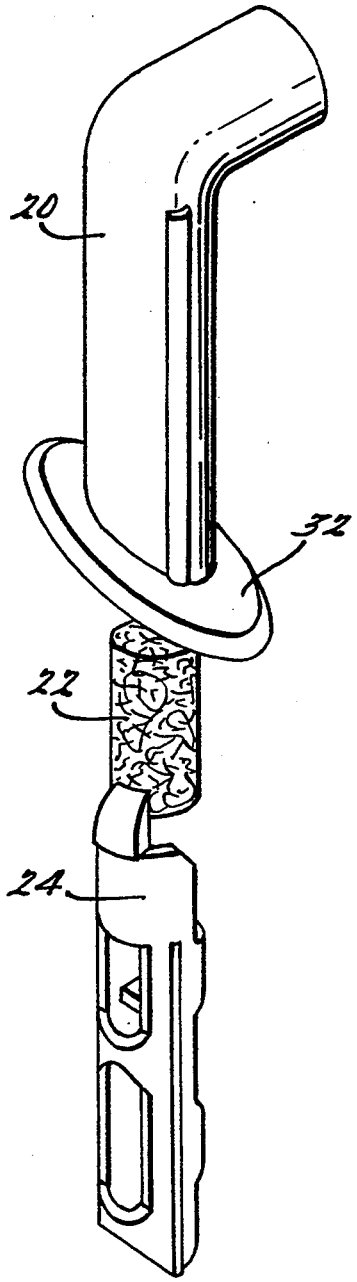
FIG. 2.
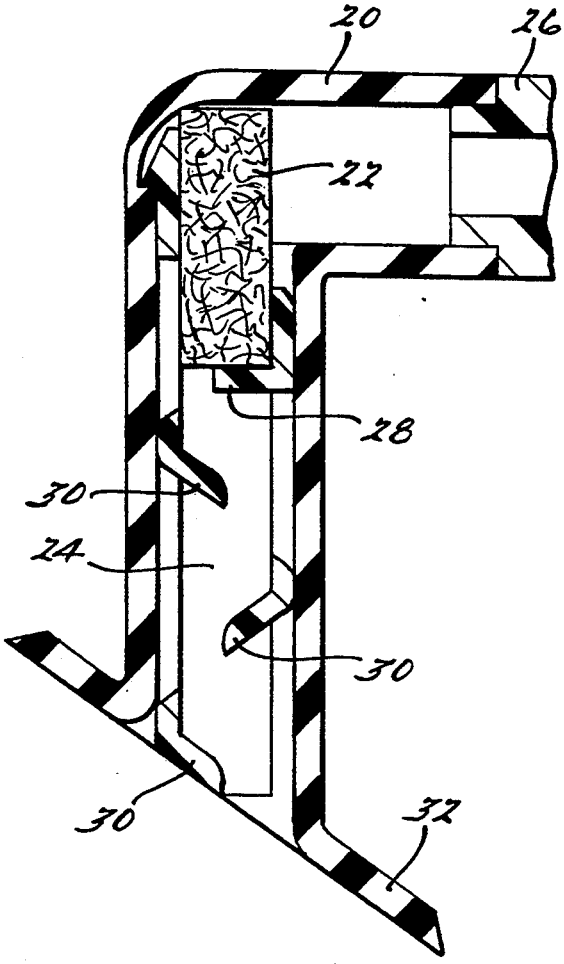
FIG. 3.

VENTILATION SYSTEM FOR MOTOR VEHICLE LIGHT FIXTURE

FIELD OF THE INVENTION

This invention relates to a ventilation system for a motor vehicle light fixture. More particularly, the invention is directed to a multi-component device used to ventilate a motor vehicle light fixture having a reflective housing and replaceable bulb such as, for example, a headlamp.

BACKGROUND OF THE INVENTION

The headlamps of most modern motor vehicles comprise a reflective housing closed by a transparent lens, a replaceable bulb inserted within a removable socket adjacent the rear surface of the reflective housing, and one or more vents which allow communication between the air within the enclosed headlamp and the atmosphere surrounding same.

When the bulb is switched off, the air within the headlamp cools and contracts, causing atmospheric air to be drawn into the interior of the headlamp through the vent. Any moisture and dust contained in the inflowing air can accumulate within the headlamp. Water may condense on the reflective surfaces and the lens of the headlamp, which may interfere with the reflection and transmission of light. Moreover, dust may settle on the reflective surfaces and the lens causing reduced illumination from the headlamp. Depending upon the configuration of the vent, water splashed onto the exterior surfaces of the headlamp during normal operation of the vehicle in wet weather may also enter the headlamp, further diminishing the illumination provided by the headlamp.

U.S. Pat. No. 5,207,497 discloses a vehicle light fixture venting construction, comprising a rubber pipe having integrally molded inner baffles. The rubber pipe is attached to a portion of the light fixture having a baffling chamber. This combination is said to reduce the inspiration of dust into the light fixture. The required inner baffles for the rubber pipe and baffling chamber within the light fixture increase the complexity and cost of manufacture for the vent and light fixture.

U.S. Pat. No. 4,405,974 discloses a filter system for a lamp, comprising a filter assembly threadably fastenable to the lamp, said filter assembly containing a filter medium. Wire screens on both major surfaces of the filter medium secure the medium into a fitting of the assembly. The wire screens may corrode due to the moisture in the air passing into and out of the lamp through the filter assembly, thus blinding off the filter medium or allowing it to fall out of the fitting.

It would be desirable to have a ventilation system for a motor vehicle light fixture which would resist the accumulation dust within the fixture while allowing the elimination of moisture from therein, and which could be simply and inexpensively manufactured and installed.

SUMMARY OF THE INVENTION

Accordant with the present invention, a ventilation system which resists the inspiration of dust while allowing the elimination of moisture from a motor vehicle light fixture, which is simple and inexpensive to manufacture, has surprisingly been discovered. The ventilation system comprises:

a rubber tube, having a first end adapted for connection to the light fixture;

a filter, positioned within the rubber tube adjacent the first end of the rubber tube; and a hollow insert, including a plurality of baffles, said hollow insert positioned within the rubber tube adjacent the second end of the rubber tube.

The ventilation system of the present invention is particularly useful for providing ventilation for motor vehicle headlamps.

BRIEF DESCRIPTION OF THE DRAWINGS

FIG. 1 is a perspective view of a vehicle light fixture with a ventilation system embodying the features of the present invention.

FIG. 2 is an exploded, perspective view of a ventilation system according to the present invention.

FIG. 3 is a cross-sectional view taken along line 3—3 of FIG. 1, illustrating the ventilation system of FIG. 1.

DETAILED DESCRIPTION OF THE PREFERRED EMBODIMENT

Referring now to the Drawings and particularly to FIG. 1, there is shown generally at 10 a motor vehicle light fixture having affixed thereto a ventilation system according to the present invention. The light fixture 10 is a motor vehicle headlamp comprising a housing 12 which is reflective on at least a portion of its inner surface, and a lens 14 attached to the front thereof. A removable socket 16 is positioned adjacent the rear surface of the reflective housing 12 and connected thereto by, for example, by a bayonet mounting such as is well-known in the industry. The removable socket 16 may be disengaged from the reflective housing 12 to access a replaceable bulb (not shown). The ventilation system 18 of the present invention is attached to a port on the reflective housing 12. The ventilation system 18 provides communication between the air within the enclosed light fixture 10 and the surrounding atmosphere. Although the ventilation system 18 according to the present invention is illustrated in FIG. 1 as being connected to a motor vehicle headlamp, one ordinarily skilled in the art would readily understand that such a ventilation system 18 could be used in association with any motor vehicle light fixture.

FIGS. 2 and 3 illustrate a preferred embodiment of a ventilation system 18 according to the present invention, comprising a rubber tube 20, a filter 22, and a hollow insert 24. The rubber tube 20 may be prepared from a natural or synthetic high polymer such as those well-known in the art including, but not necessarily limited to, natural rubber, a latex rubber, a polybutadiene rubber, a polyisoprene rubber, a styrene-butadiene rubber, a nitrile rubber, a butyl rubber, an ethylene-propylene terpolymer rubber, a silicone rubber, a neoprene rubber, a polyacrylate rubber, a fluoroelastomeric rubber, a chlorinated polyethylene rubber, a polyurethane, and the like, as well as mixtures thereof. The rubber tube 20 may be formed by any conventional process such as, for example, injection molding. Although the illustrated rubber tube 20 has a substantially circular cross-sectional shape, any cross-sectional shape may be used. Moreover, the rubber tube may be straight, or have one or more elbows as illustrated in FIGS. 1-3. The rubber tube 20 is adapted for connection to the light fixture 10 by any conventional means. In FIG. 3, the rubber tube 20 is frictionally attached to a port 26 on the reflective housing 12. Alternatively, the rubber tube 20 may be connected to the light fixture 10 using conventional means such as an adhesive, a clamp, a threaded coupling, etc. (not shown).

The filter 22 may be prepared from conventional materials including, but not necessarily limited to, porous rubber or plastic, glass fibers, polymeric fibers, etc., as well as combinations thereof. The filter 22 must have a pore size great enough to allow water vapor to easily exit the light fixture 10, yet small enough to effectively resist the inspiration of a substantial amount of the dust particles from any inflowing stream of air. Preferably, the filter 22 is a plug of reticular polyethylene or polypropylene foam having a pore size from about 10 to about 45 pores per square inch; most preferably, the pore size is from about 30 to about 40 pores per square inch. The outer shape and dimensions of the filter 20 should approximately coincide with the configuration of the inner surface of the rubber tube 20 such that all air passing through the rubber tube 20 will effectively pass through the filter 22. The filter 22 is positioned within the rubber tube 20 adjacent the end of the rubber tube 20 nearest its connection to the light fixture 10. As is readily apparent in FIG. 3, the filter 22 need not be immediately adjacent the end of the rubber tube 22. As illustrated in FIG. 3, the filter 22 may also be partially retained in the rubber tube 20 by means of a stop 28 on the hollow insert 24.

The hollow insert 24 may be prepared from conventional plastic materials including, but not necessarily limited to, thermoplastics such as acrylics, cellulosics, nylons, polycarbonates, polyethylenes, polyimides, polypropylenes, polyvinyl chlorides, styrenics, and the like, and thermosets such as epoxies, phenolics, unsaturated polyesters, polyurethanes, vinyl esters, and the like, as well as blends and copolymers thereof. A preferred plastic material is polypropylene. The hollow insert 24 may be manufactured by conventional techniques such as, for example, injection molding. By the term "hollow" as it is used herein is meant that, when the hollow insert 24 is placed into the rubber tube 20, air may nevertheless flow through the rubber tube 20 albeit following a tortuous path over and around the features of the hollow insert 24. The hollow insert 24 includes a plurality of baffles 30 which extend at least partially into the air flow path and cause the air moving through the hollow insert 24 to turn and twist, inducing airborne droplets of water entrained in the air to fall out and not be carried through the rubber tube 20 into the light fixture 10. FIGS. 2 and 3 illustrate three such baffles 30, although more or less could provide substantially the same operability and utility. In the preferred embodiment illustrated in FIGS. 2 and 3, the baffles 30 are angled downwardly in the direction of the end of the rubber tube 20 exposed to the atmosphere so that water that is knocked out in the hollow insert 24 may easily drop out of the end of the rubber tube 20. The hollow insert 24 is positioned within the rubber tube 20 adjacent the end of the rubber tube 20 exposed to the atmosphere. Preferably, as illustrated in FIGS. 2 and 3, the outer configuration of the hollow insert 24 substantially conforms to the inner surface of the rubber tube 20, so that the hollow insert 24 can be retained within the rubber tube 20 at least partially by frictional fitting. To assist in retaining the hollow insert 24 within the rubber tube 20, an adhesive (not shown) may be placed on the outer surface of the hollow insert 24 before it is positioned within the rubber tube 20, or the outer surface of the hollow insert 24 may be formed with latitudinal serrations (not shown). The hollow insert 24 may also assist in retaining the filter 22 within the rubber tube 20 as illustrated in FIG. 3 by means of stop 28.

The ventilation system 18 may be assembled by placing the filter 22 in contact with the hollow insert 24, and inserting both together into the rubber tube 20. Alternatively, the ventilation system 18 may be assembled by inserting the filter 22 into the rubber tube 20 and thereafter introducing the hollow insert 24 into the rubber tube 20. The assembled ventilation system 18 may then be installed on the light fixture 10 by pressing same onto the exposed port 26 of the reflective housing 12.

A preferred ventilation system 18 includes an angled flange 32 at the end of the rubber tube 20 exposed to the atmosphere. This configuration promotes the removal of water which drains out from the rubber tube 20 away from the mouth of the rubber tube 20, so that water droplets will not be entrained in the air entering the rubber tube 20. Alternatively, the angled flange 32 may be eliminated, and the end of the rubber tube 20 exposed to the atmosphere may be cut at a similar angle (not shown).

From the foregoing description, one ordinarily skilled in the art can easily ascertain the essential characteristics of this invention and, without departing from the spirit and scope thereof, can make various changes and modifications to the invention to adapt it to various usages and conditions. For example, although only one ventilation system 18 is shown attached to the light fixture 10 in FIG. 1, it will be readily apparent to those ordinarily skilled in the art that a plurality of ventilation systems 18 may be .attached to the same light fixture 10.

What is claimed is:

1. A ventilation system for a motor vehicle light fixture, comprising:

a rubber tube, having a first end adapted for connection to the light fixture;

a filter, positioned within the rubber tube adjacent the first end of the rubber tube; and a hollow insert, including a plurality of baffles, said hollow insert positioned within the rubber tube adjacent the second end of the rubber tube.

2. The ventilation system according to claim 1, wherein the rubber tube has a substantially circular cross-sectional configuration.

3. The ventilation system according to claim 1, wherein the rubber tube has at least one elbow.

4. The ventilation system according to claim 1, wherein the filter is prepared from a reticular polymer foam.

5. The ventilation system according to claim 1, wherein the filter has a pore size from about 10 to about 45 pores per square inch.

6. The ventilation system according to claim 5, wherein the pore size is from about 30 to about 40 pores per square inch.

7. The ventilation system according to claim 1, wherein the filter is retained within the rubber tube at least partially by means of a stop on the hollow insert.

8. The ventilation system according to claim 1, wherein the hollow insert is prepared from polypropylene.

9. The ventilation system according to claim 1, wherein the baffles are angled in a direction toward the second end of the rubber tube.

10. The ventilation system according to claim 1, wherein the hollow insert is retained within the rubber tube at least partially by friction.

11. The ventilation system according to claim 1, further comprising an angled flange at the second end of the rubber tube.

12. In a motor vehicle headlamp, comprising a reflective housing, a transparent lens, and a replaceable bulb, the improvement wherein the headlamp is vented by the ventilation system of claim 1.

13. A motor vehicle headlamp ventilation system, comprising:

a rubber tube, having a substantially circular cross-sectional configuration, and a first end adapted for connection to the headlamp, said rubber tube including at least one elbow;

a filter, positioned within the rubber tube adjacent the first end of the rubber tube, said filter prepared from a reticular polymer foam having a pore size from about 10 to about 45 pores per square inch; and a hollow insert, including a plurality of baffles angled in a direction toward the second end of the rubber tube, said hollow insert positioned within the rubber tube adjacent the second end of the rubber tube.

14. The motor vehicle headlamp ventilation system according to claim 13, wherein the filter is retained within the rubber tube at least partially be means of a stop on the hollow insert.

15. The motor vehicle headlamp ventilation system according to claim 13, wherein the hollow insert is prepared from polypropylene.

16. The motor vehicle headlamp ventilation system according to claim 13, wherein the hollow insert is retained within the rubber tube at least partially by friction.

17. The motor vehicle headlamp ventilation system according to claim 13, further comprising an angled flange at the second end of the rubber tube.

* * * * *